US005687421A

United States Patent [19]

Murai

[11] Patent Number: 5,687,421

[45] Date of Patent: Nov. 18, 1997

[54] BASEBALL MITT AND GLOVE PROTECTING COVERS, AND BASEBALL MITT AND GLOVE WITH PROTECTIVE COVERS

[75] Inventor: Hideaki Murai, Osaka, Japan

[73] Assignee: KSK Co., Ltd., Akune, Japan

[21] Appl. No.: 872,075

[22] Filed: Apr. 22, 1992

[30] Foreign Application Priority Data

Jul. 23, 1991 [JP] Japan ..... 3-065563 U
Mar. 4, 1992 [JP] Japan ..... 4-020510 U

[51] Int. Cl.[6] ..... A41D 13/10

[52] U.S. Cl. ..... 2/19; 2/161.1; 150/154

[58] Field of Search ..... 2/19, 16, 18, 46, 2/160, 161.1; 150/154

[56] References Cited

U.S. PATENT DOCUMENTS

| | | | |
|---|---|---|---|
| 447,233 | 2/1891 | Decker | 2/19 |
| 461,847 | 10/1891 | Price | 2/19 |
| 528,343 | 10/1894 | Rogers | 2/19 |
| 800,169 | 9/1905 | Peach | 2/19 |
| 812,921 | 2/1906 | Decker | 2/19 |
| 4,637,610 | 1/1987 | Carr | 2/19 |
| 5,012,529 | 5/1991 | Murai | 2/19 X |
| 5,107,544 | 4/1992 | Capatosto | 2/16 |

*Primary Examiner*—Diana Biefeld
*Attorney, Agent, or Firm*—Armstrong, Westerman, Hattori, McLeland & Naughton

[57] ABSTRACT

Herein disclosed is a baseball mitt or glove which can be used in play for a long time after it has been seasoned. For this long use, the baseball mitt or glove is protected by a protective cover which has a sheet cover body sized to protect the whole or proper area of the catching face of the mitt or glove. This cover body is removably fastened on the catching face of the mitt or glove by fastening means.

4 Claims, 18 Drawing Sheets

15
14
15
14
15
14

BASEBALL MITT AND GLOVE PROTECTING COVERS, AND BASEBALL MITT AND GLOVE WITH PROTECTIVE COVERS

BACKGROUND OF THE INVENTION

1. Field of the Invention

The present invention relates to both baseball mitt and glove protecting covers, which are to be fastened in contact on the catching faces of the mitt and glove so as to allow the mitt and glove to stand long use, and baseball mitt and glove equipped with the protective covers.

2. Description of the Prior Art

Ordinarily, the baseball mitt or glove cannot be customized before a new one is considerably seasoned from in plays or matches.

Of the baseball mitt and glove, however, a catcher mitt is so frequently and seriously used that its catching face is broken when it is seasoned and customized. Thus, the broken one has to be replaced by another new one. This raises a problem that the customized baseball mitt or glove cannot be used in matches for a long time although it is very expensive.

SUMMARY OF THE INVENTION

The present invention has an object to provide both baseball mitt and glove protecting covers, which enable baseball mitt and glove to be used in matches for a long time after they are seasoned and customized, and baseball mitt and glove equipped with those protective covers.

In order to achieve the above-specified object, according to the present invention, there is provided a baseball mitt protecting cover which comprises: a sheet cover body sized to protect the whole or proper area of the catching face of a baseball mitt; and fastening means for removably fastening the cover body on the catching face of the mitt. In order to achieve the same object, there is also provided a baseball mitt protected by a protective cover which comprises: a sheet cover body sized to protect the whole or proper area of the catching face of the baseball mitt; and fastening means for removably fastening the cover body on the catching face of the mitt.

In view of a later-described effect, on the other hand, the fastening means to be used for the baseball mitt may preferably include: a plurality of fastening bands extended from the cover body and each having a face fastener; and a retaining strap arranged on the back of the mitt for allowing the fastening bands to be folded back and anchored therearound by their respective face fasteners.

In order to achieve the above-specified object, on the other hand, there is provided a baseball glove protecting cover which comprises: a sheet cover body sized to protect the whole or proper area of the catching face of a baseball glove; and fastening means for removably fastening the cover body on the catching face of the glove. In order to achieve the same object, there is also provided a baseball glove protected by a protective cover which comprises: a sheet cover body sized to protect the whole or proper area of the catching face of the baseball glove; and fastening means for removably fastening the cover body on the catching face of the glove.

In view of a later-described effect, on the other hand, the fastening means to be used for the baseball glove may preferably include: said fastening means includes a plurality of fastening bands extended from the cover body and each having a face fastener for being wound and anchored on the thumbstall and fingerstalls of the glove by their respective face fasteners.

As has been described hereinbefore, the baseball mitt or glove protecting cover of the present invention can be used for practices with its catching face being protected by the cover body such that the cover body is fastened in contact on the whole or proper portion of the mitt or glove by the fastening means. For matches, on the other hand, the mitt or glove can be used without the protective cover.

Next, in case the fastening means of the baseball mitt protecting cover is exemplified by the fastening means including: a plurality of fastening bands extended from the cover body and each having a face fastener; and a retaining strap arranged on the back of the mitt for allowing the fastening bands to be folded back and anchored therearound by their respective face fasteners, for the practices, the cover body can be fastened in contact on the catching face of the mitt by folding back and anchoring the fastening bands of the fastening means around the retaining strap by the face fasteners. For the matches, on the other hand, the cover body can be released by removing the fastening bands of the fastening means from the retaining strap.

Moreover, in case the fastening means of the baseball glove protecting cover is exemplified by the fastening means including a plurality of fastening bands extended from the cover body and each having a face fastener for being wound and anchored on the thumbstall and fingerstalls of the glove by their respective face fasteners, for the practices, the cover body can be fastened in contact on the catching face of the glove by winding and anchoring the fastening bands on the thumbstall and fingerstalls of the glove by their respective fasteners.

DETAILED DESCRIPTION OF THE PREFERRED EMBODIMENTS

The present invention will be described in more detail in connection with the embodiments thereof with reference to the accompanying drawings.

FIGS. 1 to 11 show catcher mitt protecting covers 100 (as will be shortly referred to as "protective cover 100") according to first to sixth embodiments of the present invention; and FIGS. 12 to 15 show first mitt protecting covers (as will be shortly referred to as "protective cover 200") according to first and second embodiments of the present invention. Moreover, FIGS. 16 to 20 show baseball glove protecting covers 300 (as will be shortly referred to as "protective cover 300") according to first to fourth embodiments of the present invention.

Figure 1:
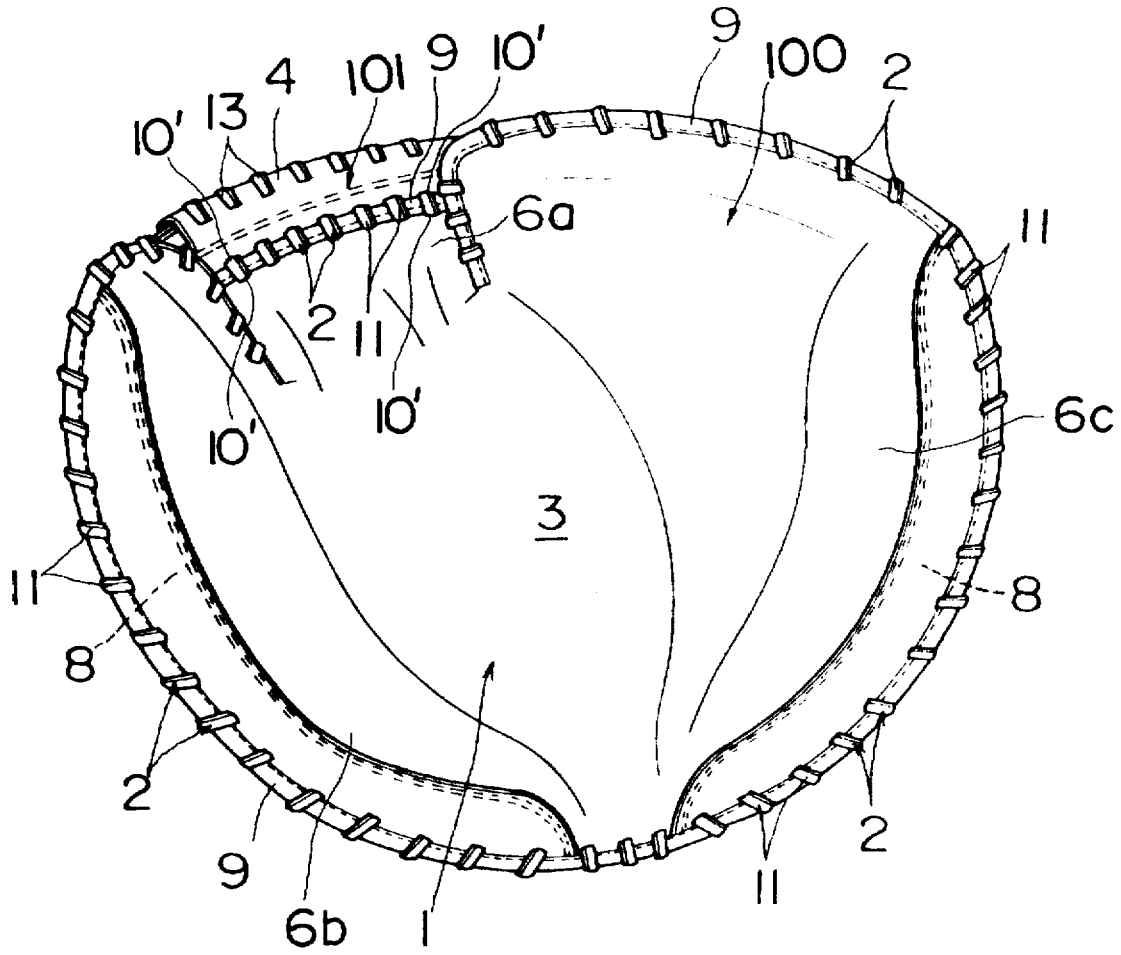
FIG. 1 is a perspective view showing the state, as taken from the side of a catching face, in which a catcher mitt protecting cover according to a first embodiment is fastened on a catcher mitt.
Figure 2:
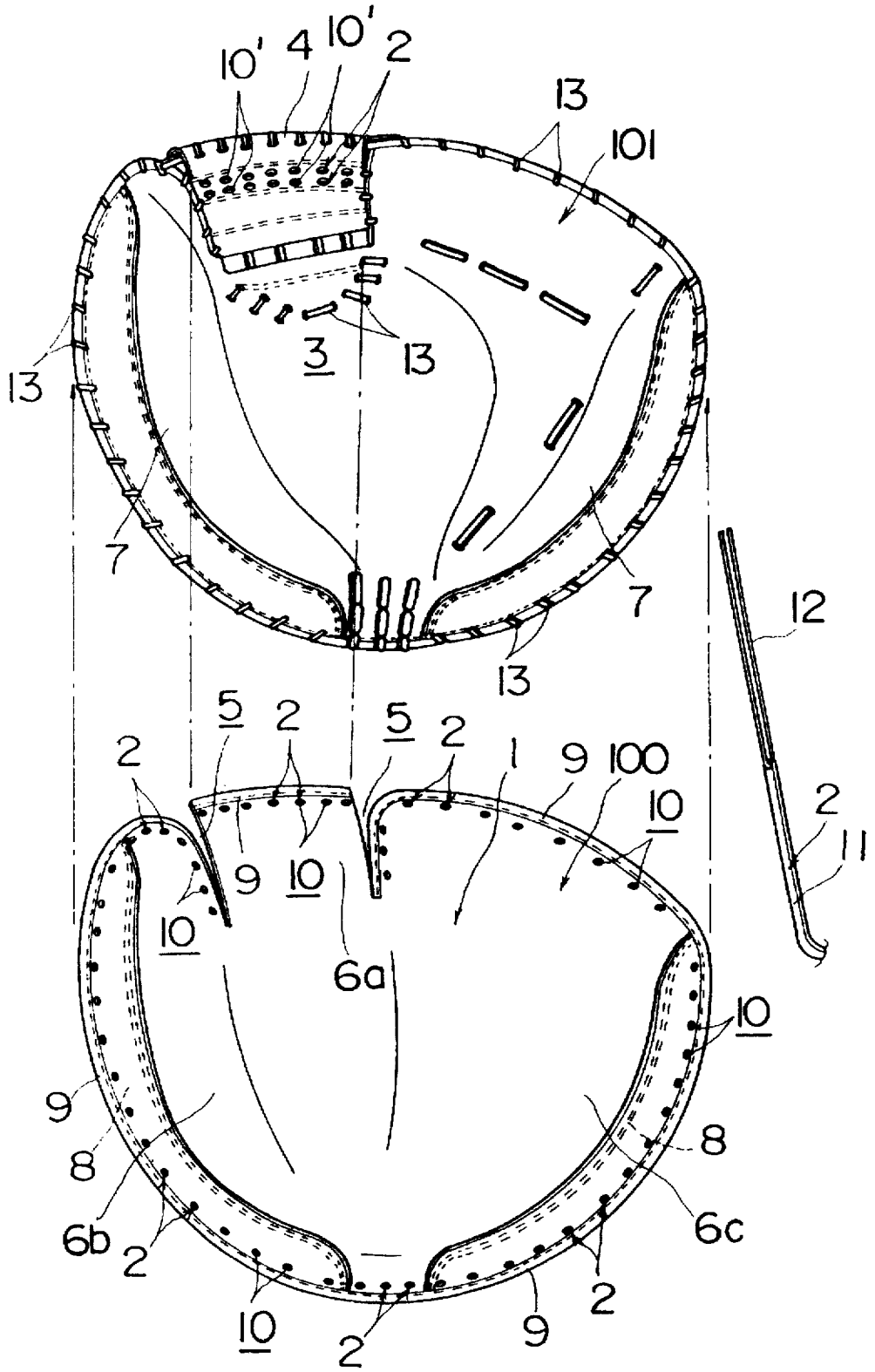
FIG. 2 is an exploded perspective view also taken from the side of the catching face and showing the state before the protective cover is fastened on the catcher mitt.

First of all, the protective covers 100 and 200 are fastened on baseball mitts such as a catcher mitt 101 and a first mitt 201, each of which is composed of a cover body 1 and fastening means 2. The cover body 1 in the protective cover 100 of the first embodiment is made of a sheet of leather, artificial leather, synthetic leather or felt, which is sized to protect substantially the whole area of a catching face 3 of the mitt 101. A web cover 4 of the mitt 101 is defined by cutting, as at 5 and 5, the upper portion of the cover body 1 to form a web portion **6*a* while leaving side portions 6*b* and 6*c*. In order to contact closely with banked side end portions 7 and 7 of the mitt 101, the cover body 1 is formed at its side and lower portions with accommodating portions 8 and 8 which are depressed at their backs. The cover body 1 reinforced at its peripheral edge with a hemming portion 9 which in turn is formed therealong with stitch holes 10, 10, - - - , and so on. On the other hand, the fastening means 2 is exemplified, as shown in FIG. 2, by threading a U-shaped needle 12 around the leading end of a strap 11, and by entangling the stitch holes 10 of the cover body 1 and the hemming strap 13 of the mitt 101 with the strap 11 by means of the needle 12 such that the cover body 1 is held in contact with the catching face 3 of the mitt 101. Thus, the cover body 1 is fastened on the catching face 3 of the mitt 101, as shown in FIG. 1. Especially in the embodiment, as shown in FIG. 2, the web cover 4 of the mitt 101 is also formed with stitch holes 10', 10', - - -, and so on so that the cover body 1 is fastened more reliably on the catching face 3 of the mitt 101. In case the cover body 1 is to be removed, on the other hand, the reverse procedures can be followed to release the strap 11 of the fastening means 2. In these ways, the cover body 1 can be removably fastened on the catching face 3 of the mitt 101**.

Figure 3:
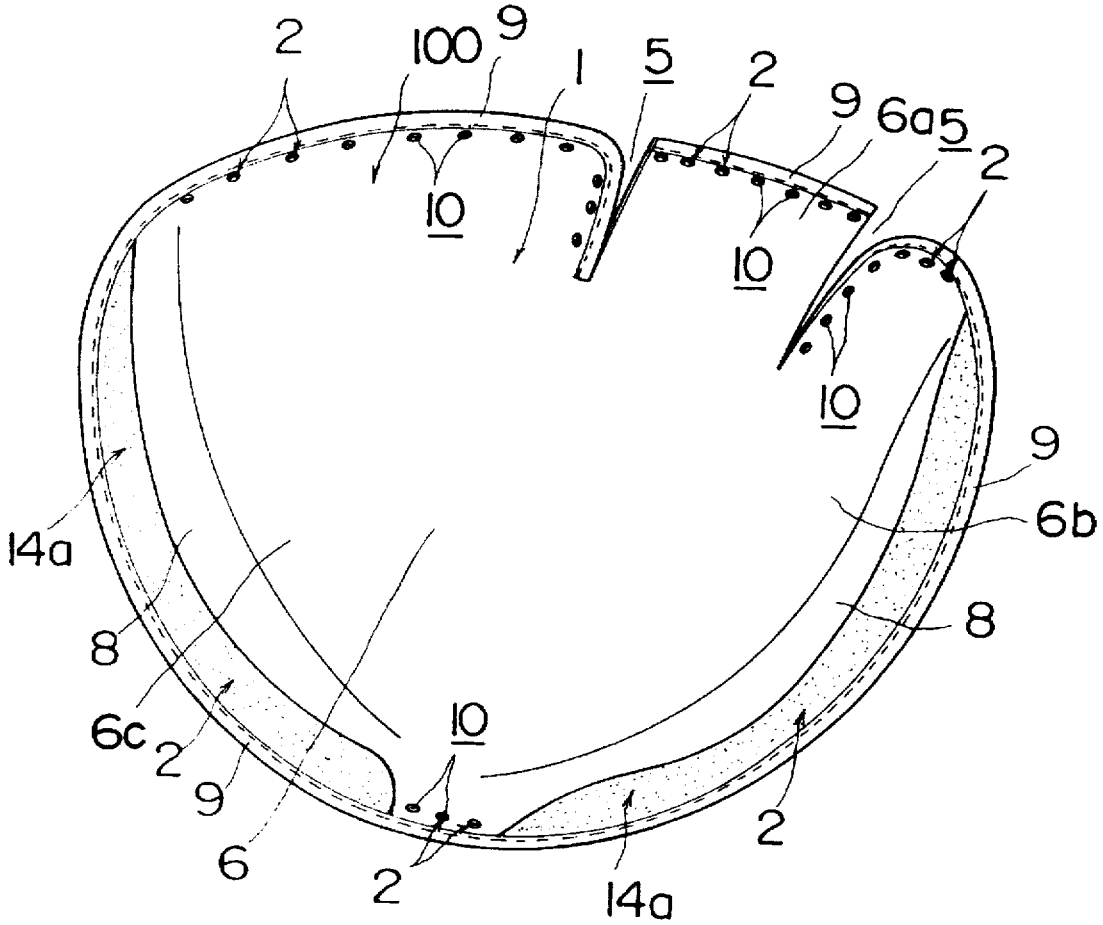
FIG. 3 is a back elevation showing a catcher mitt protecting cover according to a second embodiment.

What is shown in FIG. 3 is the protective cover 100 according to the second embodiment. Specifically, the protective cover 100 of the second embodiment is made to have a structure substantially identical to that of the protective cover 100 of the first embodiment. However, the accommodating portions 8 of the cover body 1 are equipped on their inner faces with face fasteners **14*a* of one type, and the (not-shown) face fasteners of another type are adhered to the surfaces of the side end portions 7 of the mitt 101. In short, the fastening means 2 is exemplified by the face fasteners 14 which are adhered to both the catching face 3 of the mitt 101 and the portions of the contact faces of the cover body 1**.

Incidentally, the shown protective cover 100 of the second embodiment is constructed such that the face fasteners **14*a* of one type are adhered to the inner faces of the accommodating portions 8 of the cover body 1. Despite of this construction, however, the positions of adhesion should not be limited to those portions but may be others. Moreover, by forming not the stitch holes 10 but the one-type face fasteners 14*a* along the whole periphery of the back of the cover body 1, the fastening means 2 can be so simply modified by the use of the face fasteners only that the cover body 1 may be removably fastened on the catching face 3 of the mitt 101**.

Although not shown, moreover, the fastening means 2 could also be exemplified by double-coated tape.

Figure 4:
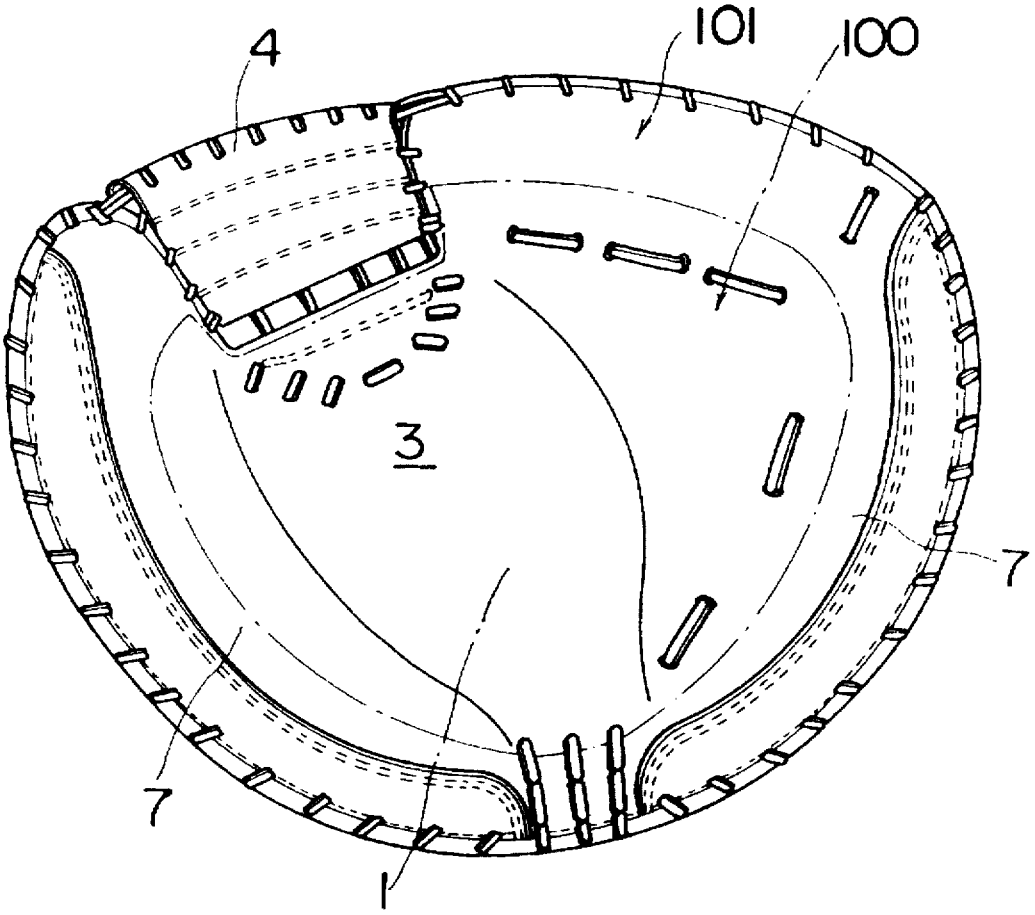
FIG. 4 is an explanatory view showing the state in which a catcher mitt protecting cover according to a third embodiment is fastened on a catcher mitt.

What is shown in phantom lines in FIG. 4 is the protective cover 100 according to the third embodiment. Specifically, the protective cover 100 of the third embodiment is substantially identical in the structure to the protective cover 100 of the first or the second embodiment but is different therefrom in that the size of the cover body 1 is reduced to protect only such a portion of the catching face 3 of the mitt 101 as is especially liable to wear. In addition, the cover body 1 could be sized to protect only the proper portion or portions of the catching face 3 of the mitt 101.

Figure 5:
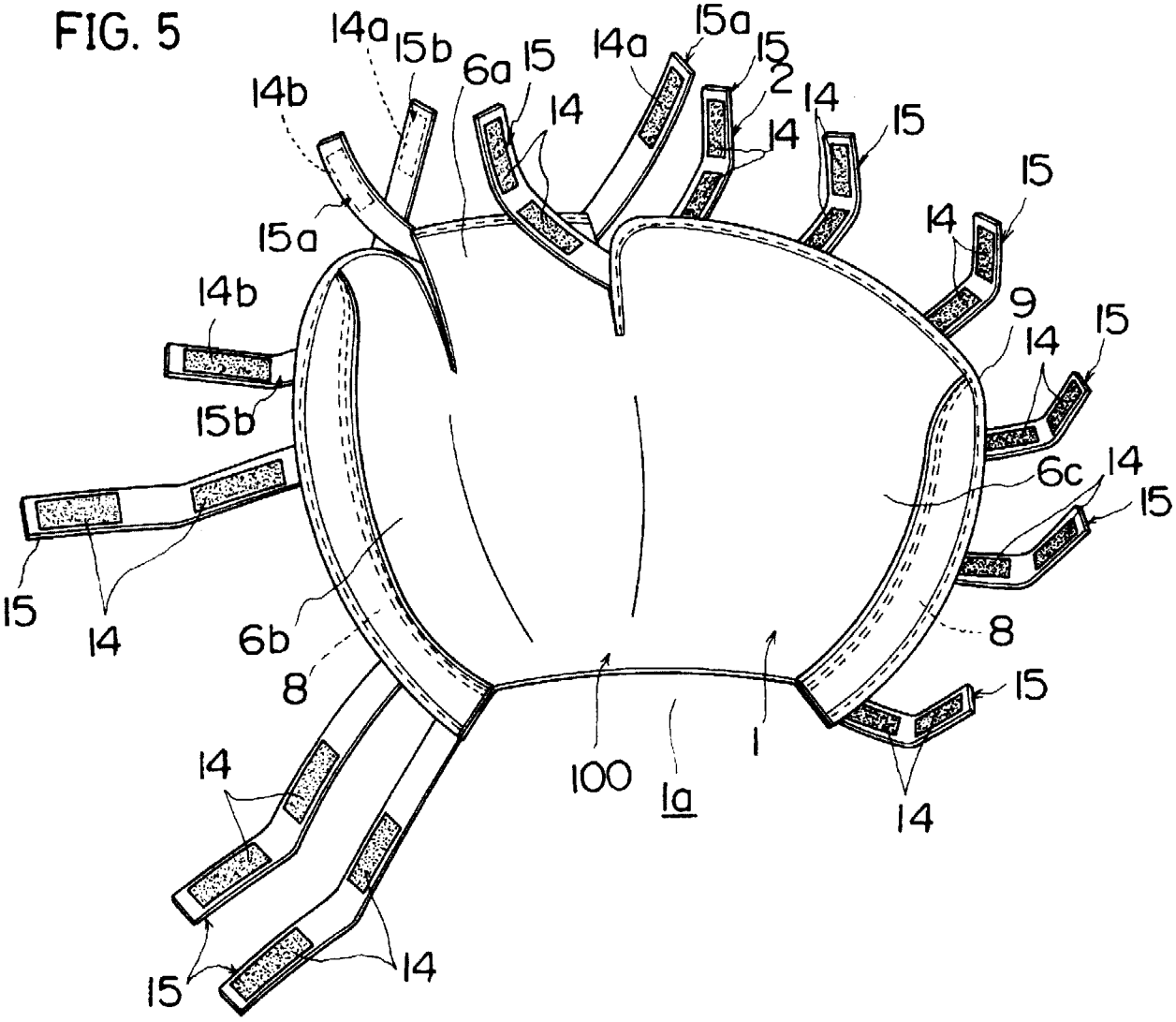
FIG. 5 is a front elevation showing a catcher mitt protecting cover according to a fourth embodiment.
Figure 6:
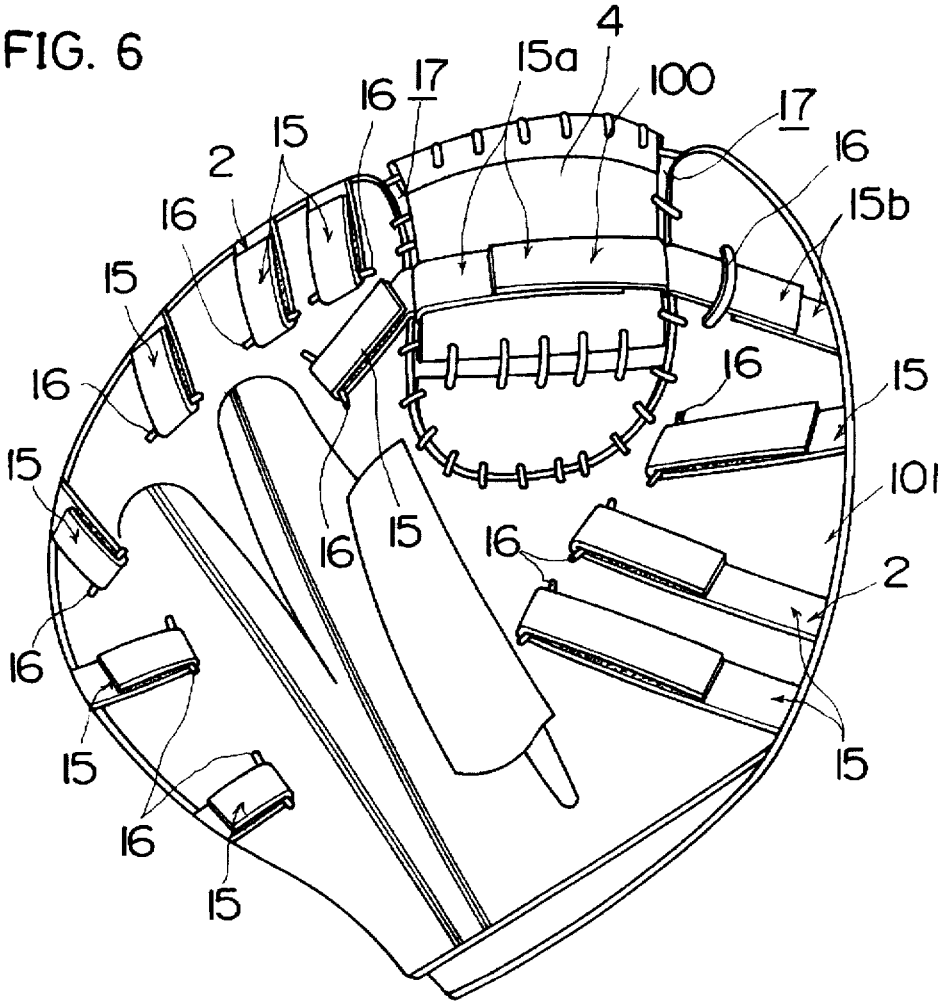
FIG. 6 is a perspective view taken from the back and showing the state in which the same protective cover is fastened on a catcher mitt.
Figure 7:
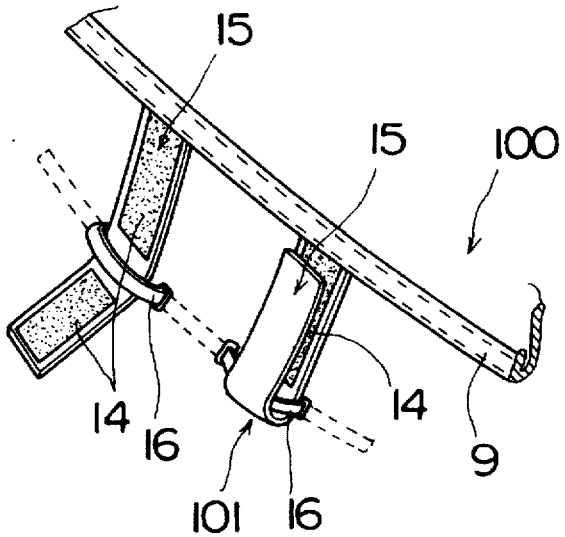
FIG. 7 is a perspective view showing the state of an essential portion, in which the same protective cover is fastened on the catcher mitt.

What is shown in FIGS. 5 and 6 is the protective cover 100 according to the fourth embodiment. The protective cover 100 of the fourth embodiment is made, as shown in FIG. 5, to have a structure substantially identical to that of the protective cover 100 of the first embodiment shown in FIG. 2. However, the cover body 1 has its lower portion **1*a* cut away, and the fastening means 2 is exemplified by providing a plurality of fastening bands 15, 15, - - - , and so on,, which are extended from the end portions of the cover body 1 and have the face fasteners 14 on their inner sides, and by folding back and anchoring the fastening bands 15 around a retaining strap 16 on the back of the mitt 101, as shown in FIG. 7. Here, the retaining strap 16 need not be newly attached to the mitt 101 but can be exemplified by the existing hemming strap 13 for assembling the mitt 101. More specifically, this protective cover 100 of the fourth embodiment is the most preferable for productions and sales in all the protective covers 100 to be fastened on the catcher mitt 101**.

Figure 8:
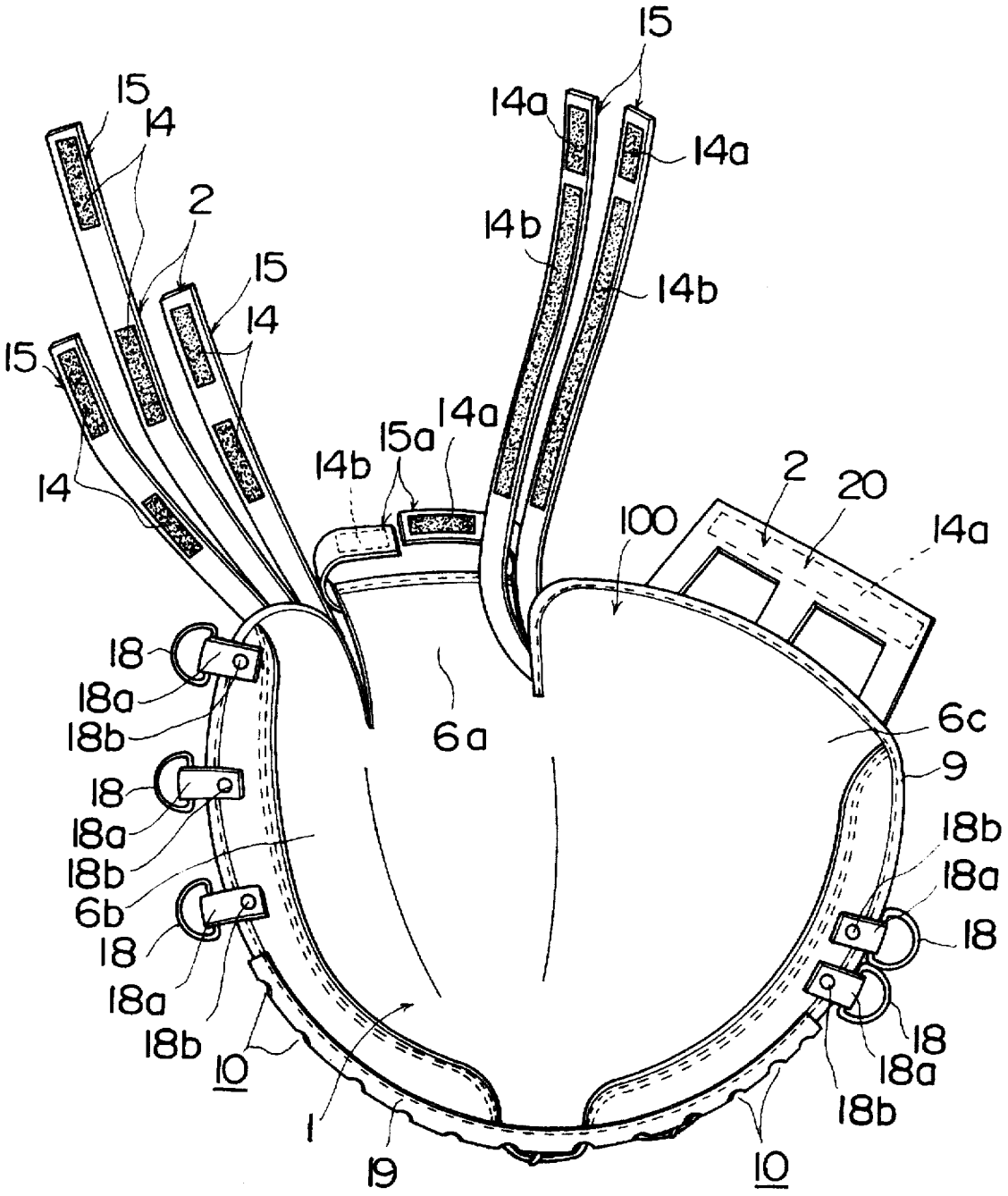
FIG. 8 is a front elevation showing a catcher mitt protecting cover according to a fifth embodiment.

What is shown in FIG. 8 is the protective cover 100 according to the fifth embodiment. The protective cover 100 of the fifth embodiment is made, as shown in FIG. 8, to have a structure substantially identical to that of the protective cover 100 of the first embodiment shown in FIG. 2. The fastening means 2 can be exemplified in the following manner. From the end portion of the web portion 6*a* of the protective cover 100, there are extended fastening bands 15*a* and 15*a* which have face fasteners 14*a* and 14*b* on their inner sides. From the leading end portions of the side portions 6*b* and 6*c* of the cover body 1, there are likewise extended the fastening bands 15 which are made longer. Fixing rings 18, 18, - - - , and so on for anchoring the fastening bands 15 therearound are attached to the end portions of the side portions 6*b* and 6*c* of the cover body 1 by means of corresponding fixing bands 18*a* and rivets 18*b*. To the lower end portion of the cover body 1, there is stitched a reinforcing member 19 which is formed with the stitch holes 10 for anchoring the strap 11 therearound. Between the fastening bands 15 and the fixing rings 18 at the side portion 6*c*, there is extended an auxiliary fastening band 20 which has the face fastener 14*a* on its inner face.

Figure 10:
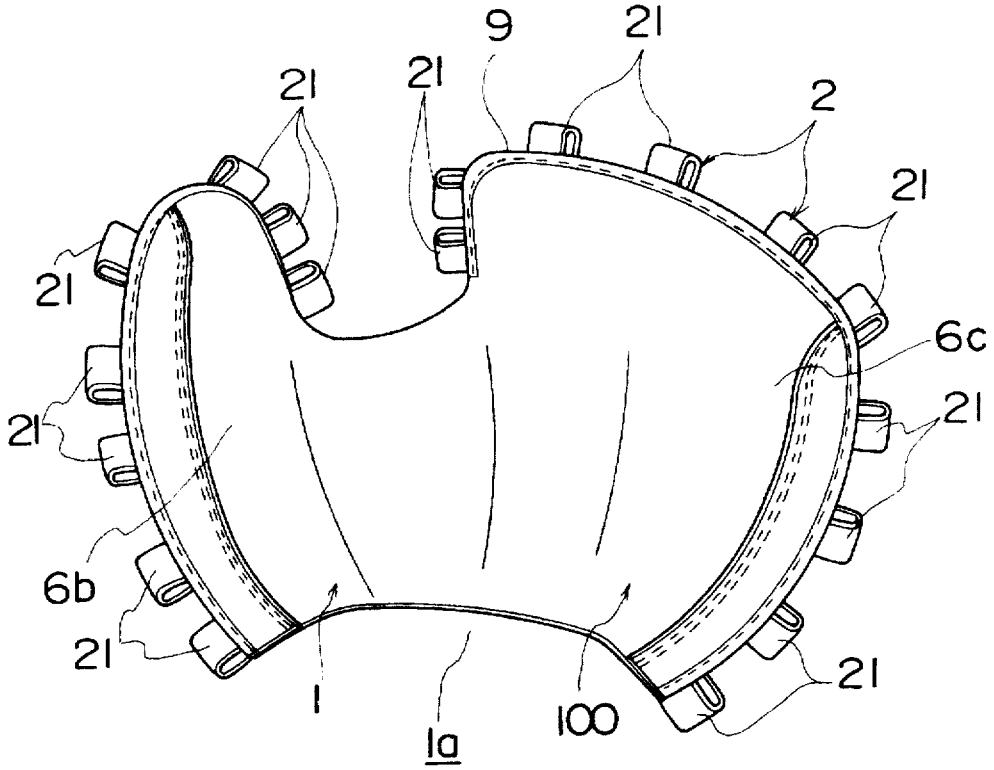
FIG. 10 is a front elevation showing a catcher mitt protecting cover according to a sixth embodiment.

What is shown in FIG. 10 is the protective cover 100 according to the sixth embodiment. The protective cover 100 of the sixth embodiment is made, as shown in FIG. 10, to have a structure substantially identical to that of the protective cover 100 of the first embodiment shown in FIG. 2. However, the lower portion 1*a* of the cover body 1 is partially cut away, but the web portion 6*a* is not provided. And, ring members 21, 21, - - - , and so on are provided by fitting the end portions of band members and by stitching the same portions to the end portion of the cover body 1.

Figure 11:
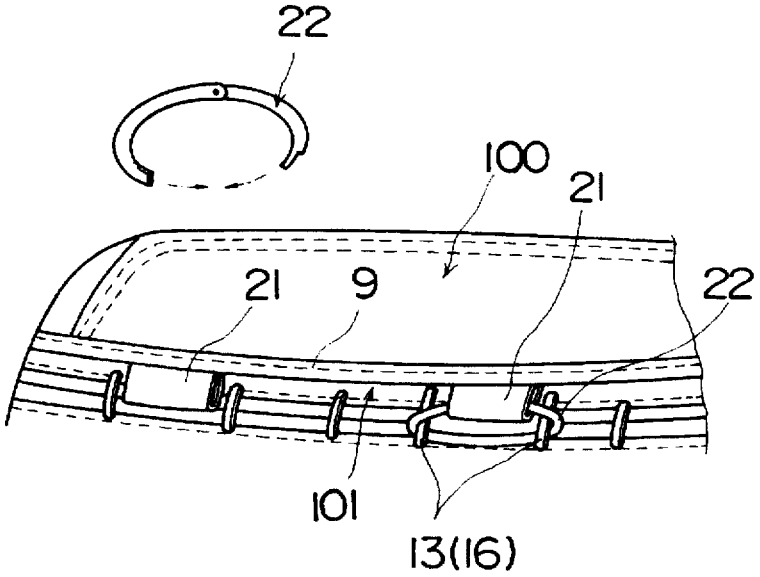
FIG. 11 is an enlarged perspective view showing the state of an essential portion, in which the same protective cover is fastened on the catcher mitt.

Although not especially shown, moreover, the protective cover 100 is fastened on the mitt 101 by threading the strap 11 into those ring members 21 and by entangling the strap 11 on either the hemming strap 13 of the mitt 101 or a new retaining strap 16. Another method of fastening the protective cover 100 can be exemplified by using not the strap 11 but openable rings 22, as shown in FIG. 11, to retain the ring members 21 and the hemming strap 13 of the mitt 101.

Here will be described the protective cover 200 to be fastened on the first mitt 201.

Figure 12:
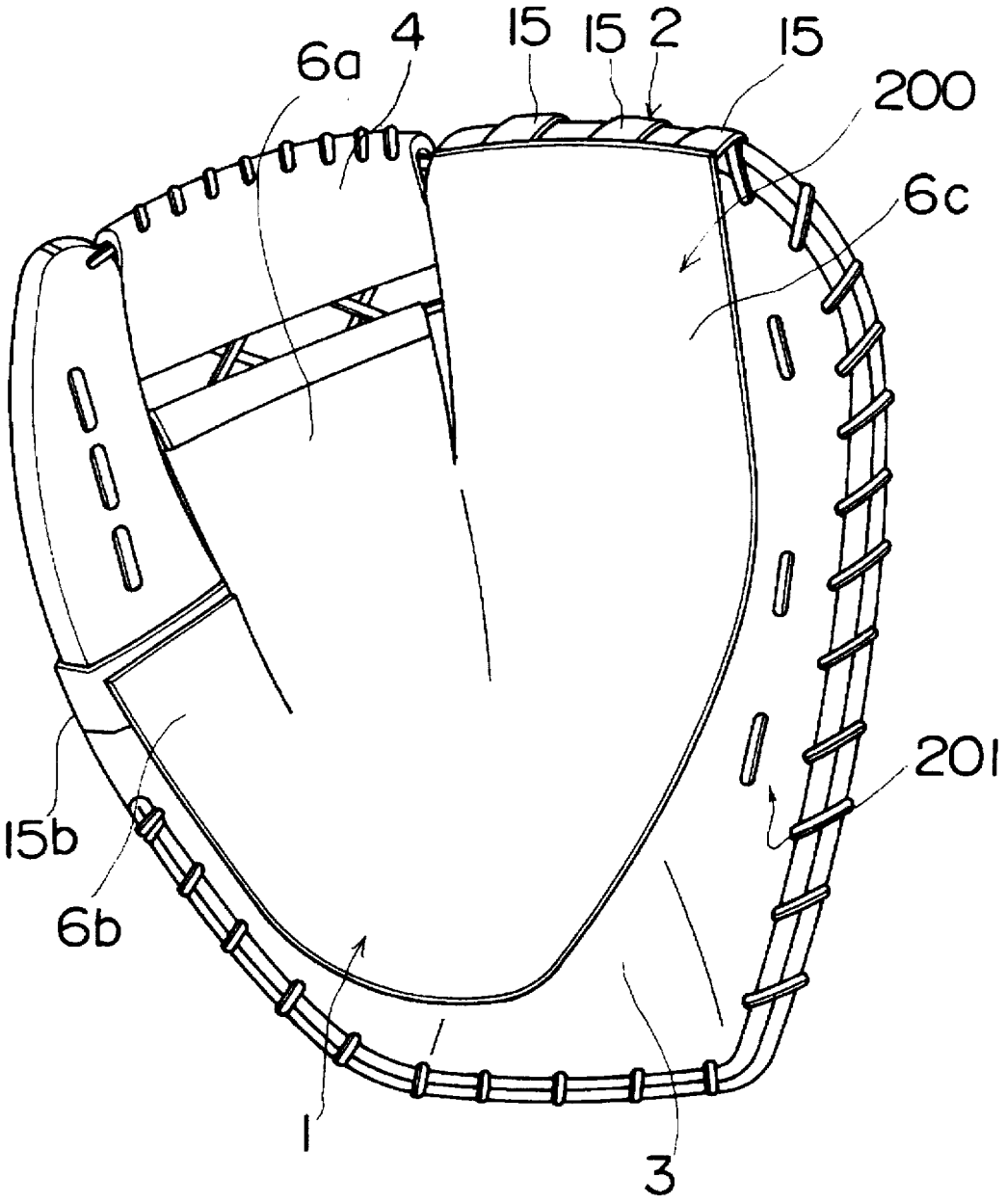
FIG. 12 is a perspective view showing the state, as taken from the side of a catching face, in which a first mitt protecting cover according to a first embodiment is fastened on a first mitt.
Figure 13:
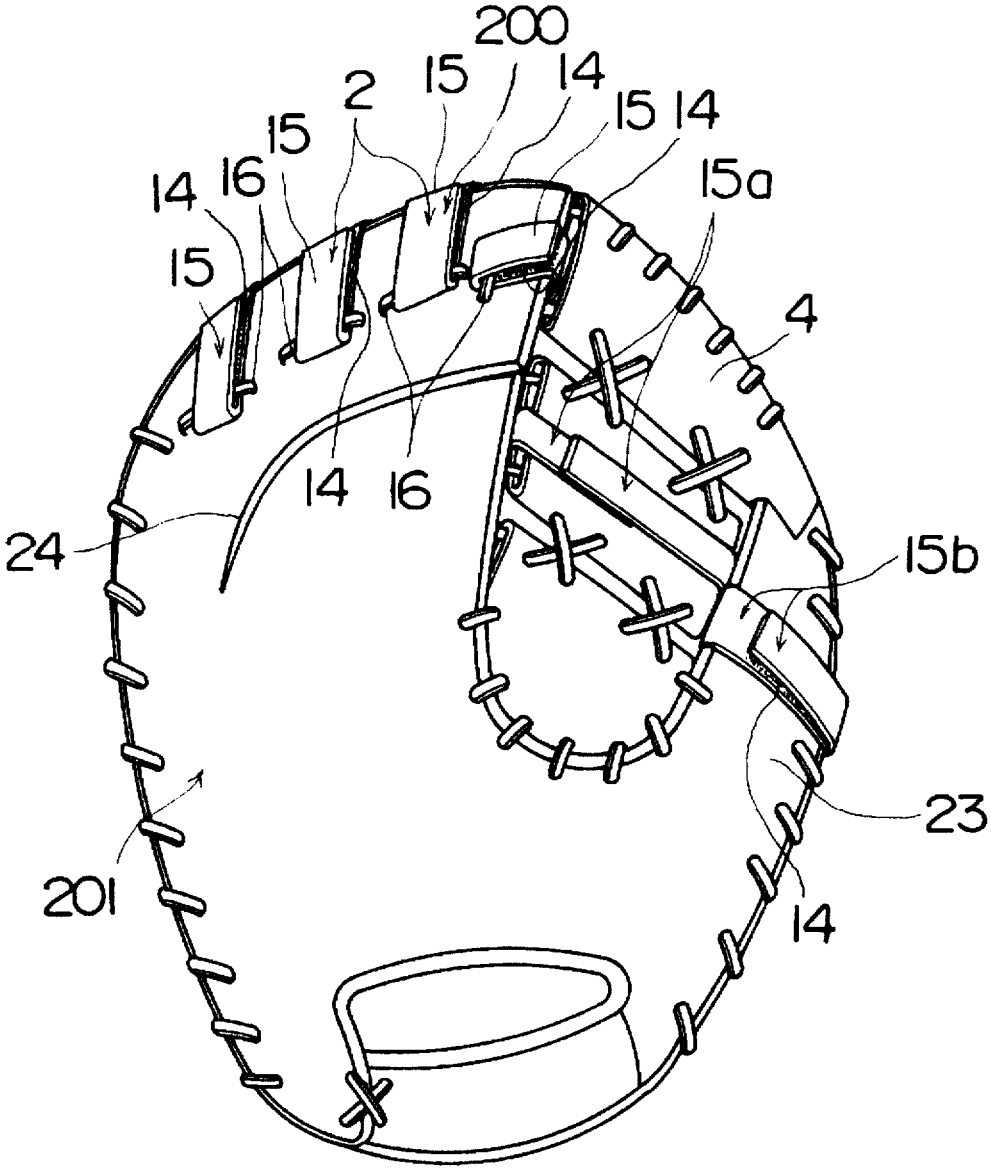
FIG. 13 is a perspective view showing the same state but is taken from the back.

What is shown in FIGS. 12 and 13 is the protective cover 200 according to the first embodiment. This protective cover 200 is made, as shown in FIGS. 12 and 13, to have a structure substantially identical to that of the protective cover 100 of the fourth embodiment shown in FIG. 5. Specifically, the protective cover 200 is sized to protect the catching face 3 of the first mitt 201. The fastening means 2 is exemplified by providing the fastening bands 15, which are extended from the end portions of the cover body 1 formed of the web portion 6*a* and the side portions 6*b* and 6*c* and which have the face fasteners 14 on their inner sides, and by folding back and anchoring the fastening bands 15 around a retaining strap 16 on the back of the first mitt 201, as shown in FIG. 13. More specifically, this protective cover 200 of the first embodiment is the most preferable for productions and sales in all the protective covers 200 to be fastened on the first mitt 201.

When in the fastening operation, moreover, the fastening bands 15*a* and 15*a* of the protective cover 200 are folded back and anchored around the web cover 4 of the first mitt 201, as shown in FIG. 13, by means of the face fasteners 14, and the fastening bands 15*b* and 15*b* are folded back and anchored around a thumbstall 23 of the first mitt 201 by means of the face fasteners 14. The other fastening bands 15 can be retained on the retaining straps 16 at the back of the first mitt 201 by means of the face fasteners 14.

Figure 14:
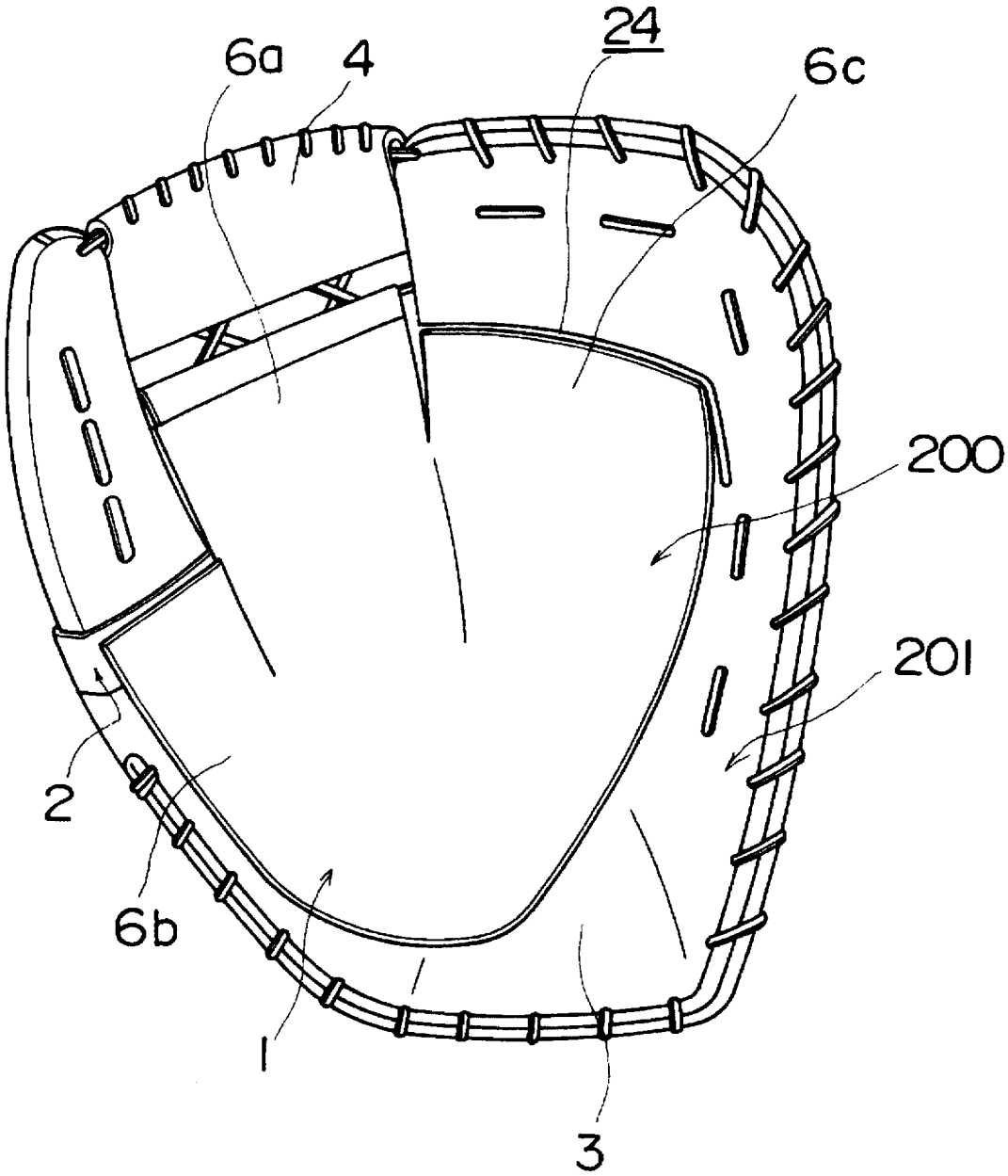
FIG. 14 is a perspective view showing the state, as taken from the side of a catching face, in which a first mitt protecting cover according to a second embodiment is fastened on a first mitt.
Figure 15:
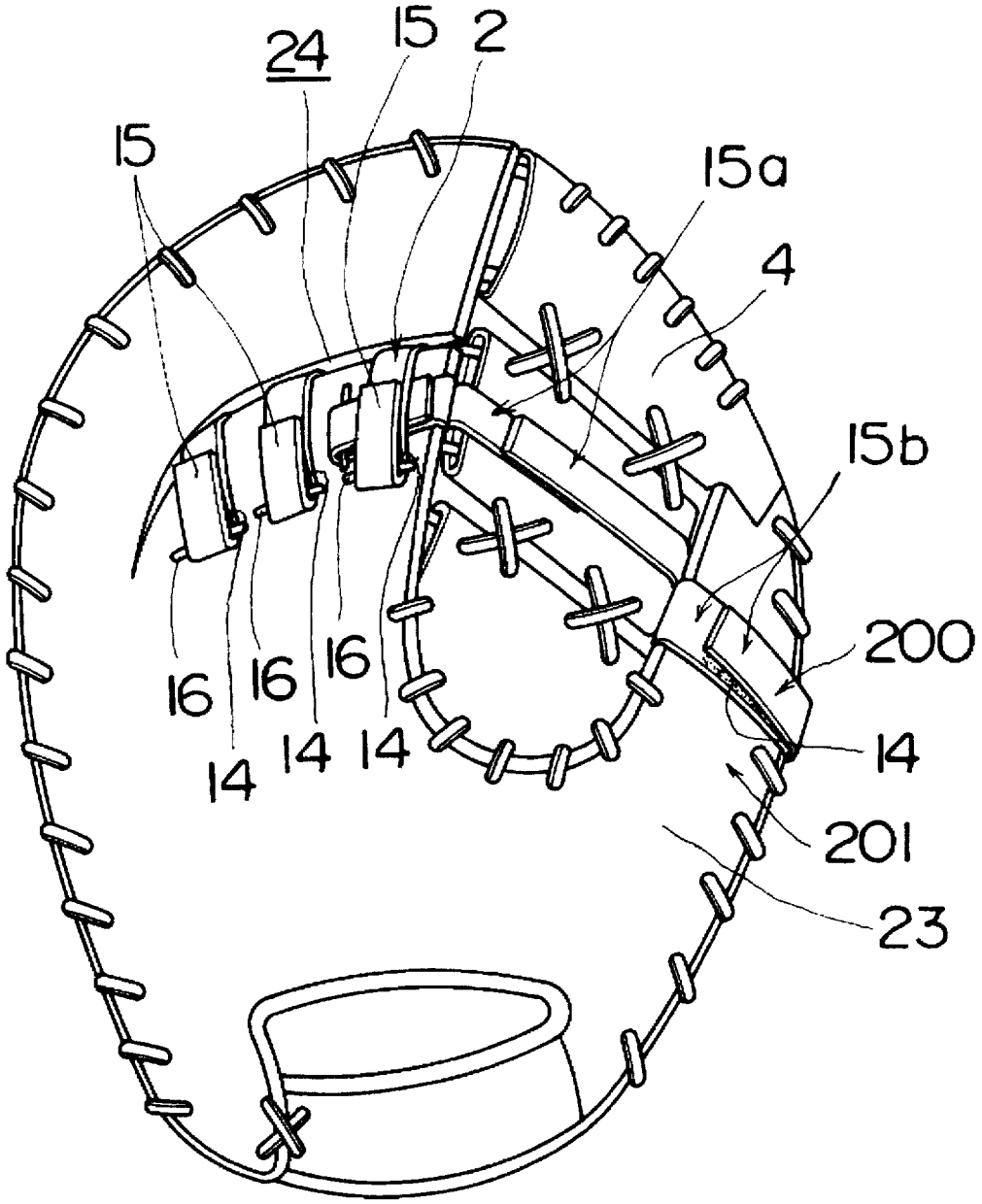
FIG. 15 is a perspective view showing the same state but is taken from the back.

What is shown in FIGS. 14 and 15 is the protective cover 200 according to the second embodiment. This protective cover 200 is made to have a structure substantially identical to that of the protective cover 200 of the first embodiment shown in FIGS. 12 and 13. The protective cover 200 of the second embodiment is exemplified, as shown in FIGS. 14 and 15, by shortening the leading end of the side portion 6*c* of the cover body 1, and by inserting the fastening bands 15 into a body cut 24 of the first mitt 201 and retaining them on the retaining straps 16 at the back of the first mitt 201.

Figure 16:
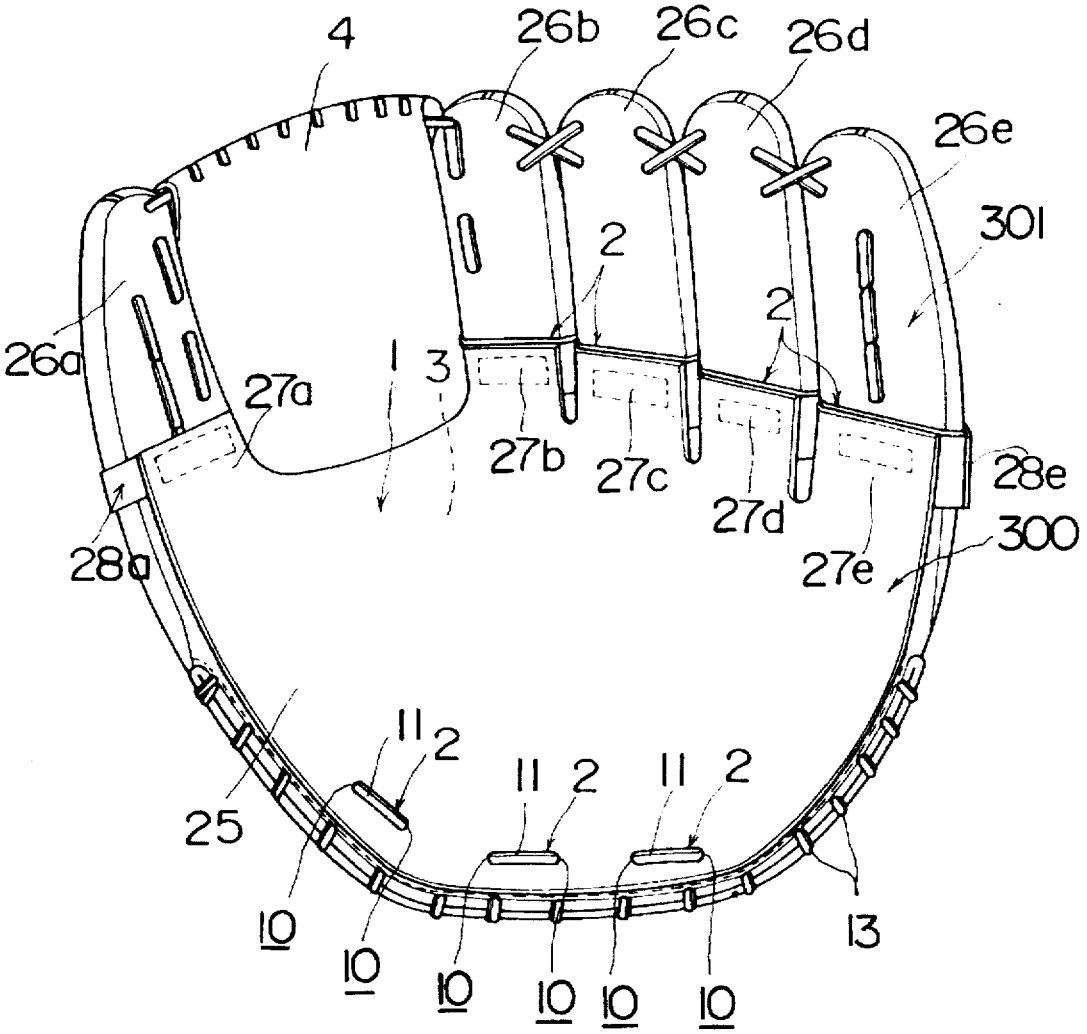
FIG. 16 is a perspective view showing the state, as taken from the side of a catching face, in which a baseball glove protecting cover according to a first embodiment is fastened on the baseball glove.
Figure 17:
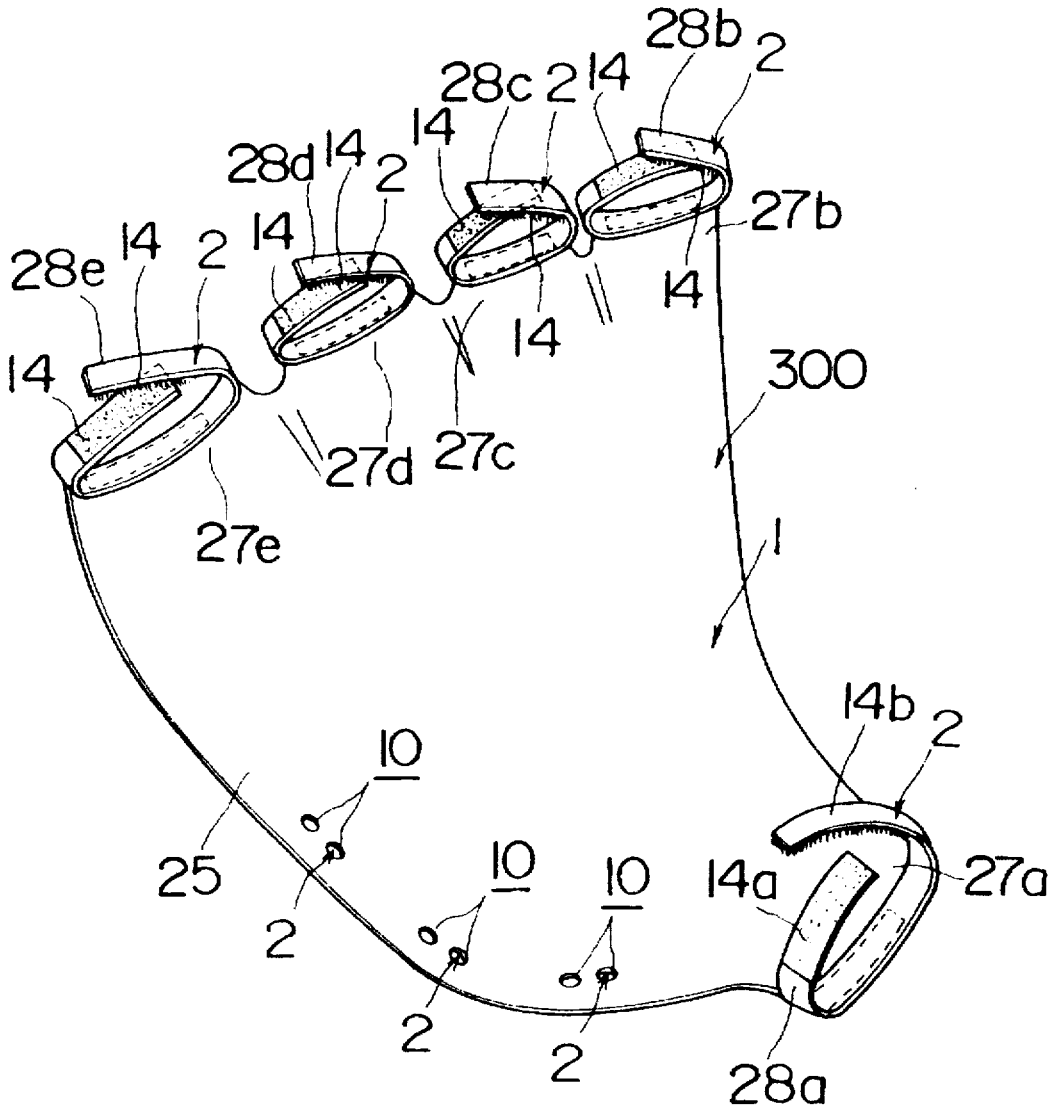
FIG. 17 is a perspective view showing the baseball glove protecting cover of the first embodiment, as taken from the back.

On the other hand, the protective cover 300 is fastened on a baseball glove 301, as shown in FIG. 16, and is constructed to include the cover body 1 and the fastening means 2. The cover body 1 in the protective cover 300 of the first embodiment is constructed by extending such a thumb member 27*a* and finger members 27*b* to 27*e* from the upper end of a catching portion 25, which is sized to protect substantially the whole area of the catching face 3 of the glove 301, as to about midway of the surfaces of a thumbstall 26*a* and fingerstalls 26*b* to 26*e*. To the backs of those finger members 27, there are fastened the central portions of mounting bands 28*a* to 28*e* which are elongated to embrace the fingerstalls 26 of the glove 301. The face fasteners 14 are adhered to those leading end portions of the fastening bands 28, which are to be overlapped, to fasten the protective cover 300 removably on the glove 301. The catching portion 25 is formed at its lower portion with the stitch holes 10. On the other hand, the fastening means 2 can be exemplified, as shown in FIGS. 16 and 17, by the fastening bands 28 having the face fasteners 14, the stitch holes 10 of the cover body 1, and the strap 11. Incidentally, the protective cover 300 of the first embodiment is equipped, as shown in FIG. 16, with the fastening bands 28 for embracing all the fingerstalls 26 and should not be especially limited but might hold arbitrary fingerstalls 26 only with the fastening bands 28.

Figure 18:
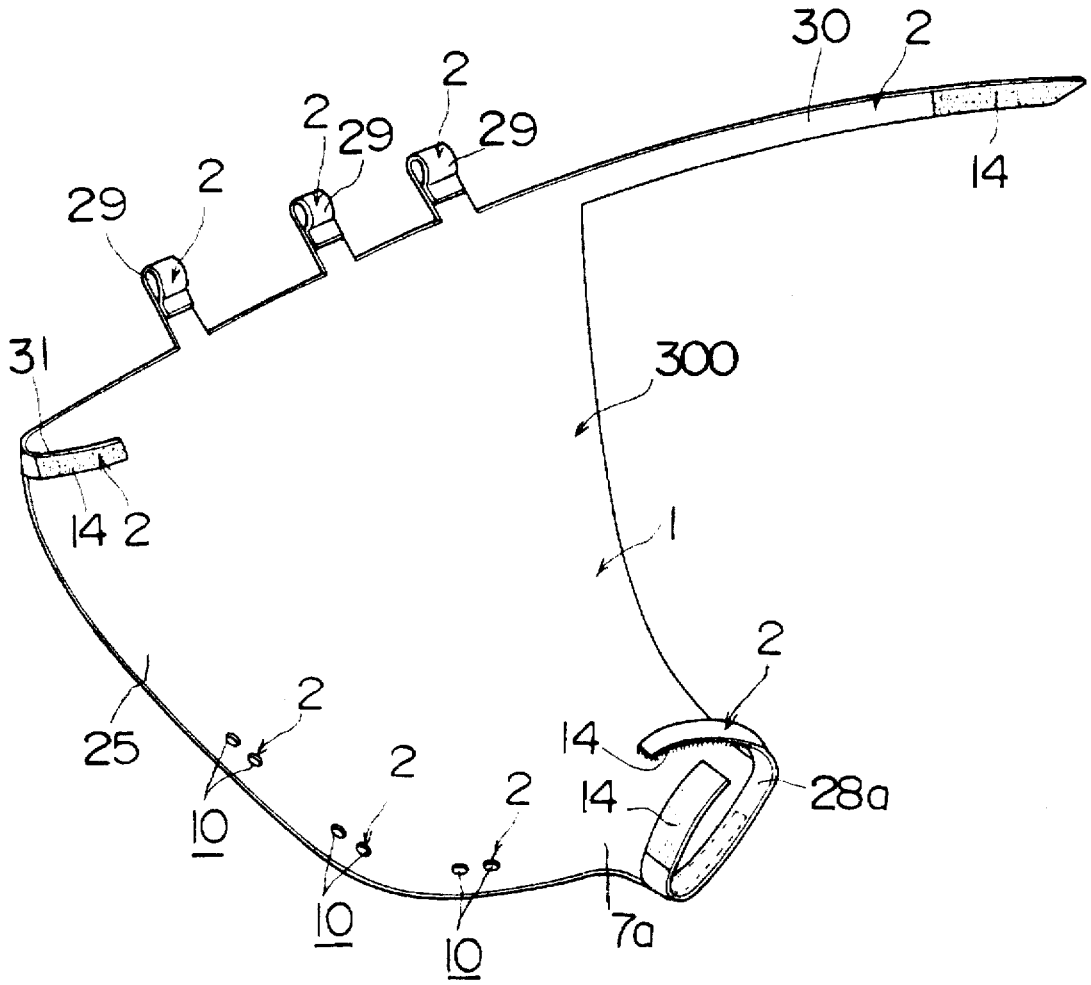
FIG. 18 is a perspective view showing a baseball glove protecting cover according to a second embodiment, as taken from the back.

What is shown in FIG. 18 is the protective cover 300 according to the second embodiment. Specifically, the protective cover 300 of the second embodiment is an improvement over the protective cover 300 of the first embodiment, and the cover body 1 is constructed by extending not the finger members 27*b* to 27*e* but such retaining rings 29, 29, - - - , and so on from the upper end of the catching portion 25 as are positioned on the back of the glove 301 through the gaps between the forefinger stall 26*b* and the middle finger stall 26*c*, between the middle finger stall 26*c* and the third finger stall 26*d*, and between the third finger stall 26*d* and the little finger stall 26*e*, and by extending fastening bands 30 and 31 from the two sides of the upper end of the catching portion 25. These fastening bands 30 and 31 have the face fasteners 14 at their portions to be overlapped. Moreover, the fastening means 2 can be exemplified, as shown in FIG. 18, by the fastening bands 30 and 31 having the face fasteners 14, the retaining rings 29, the stitch holes 10 of the cover body 1, and the strap 11.

Figure 19:
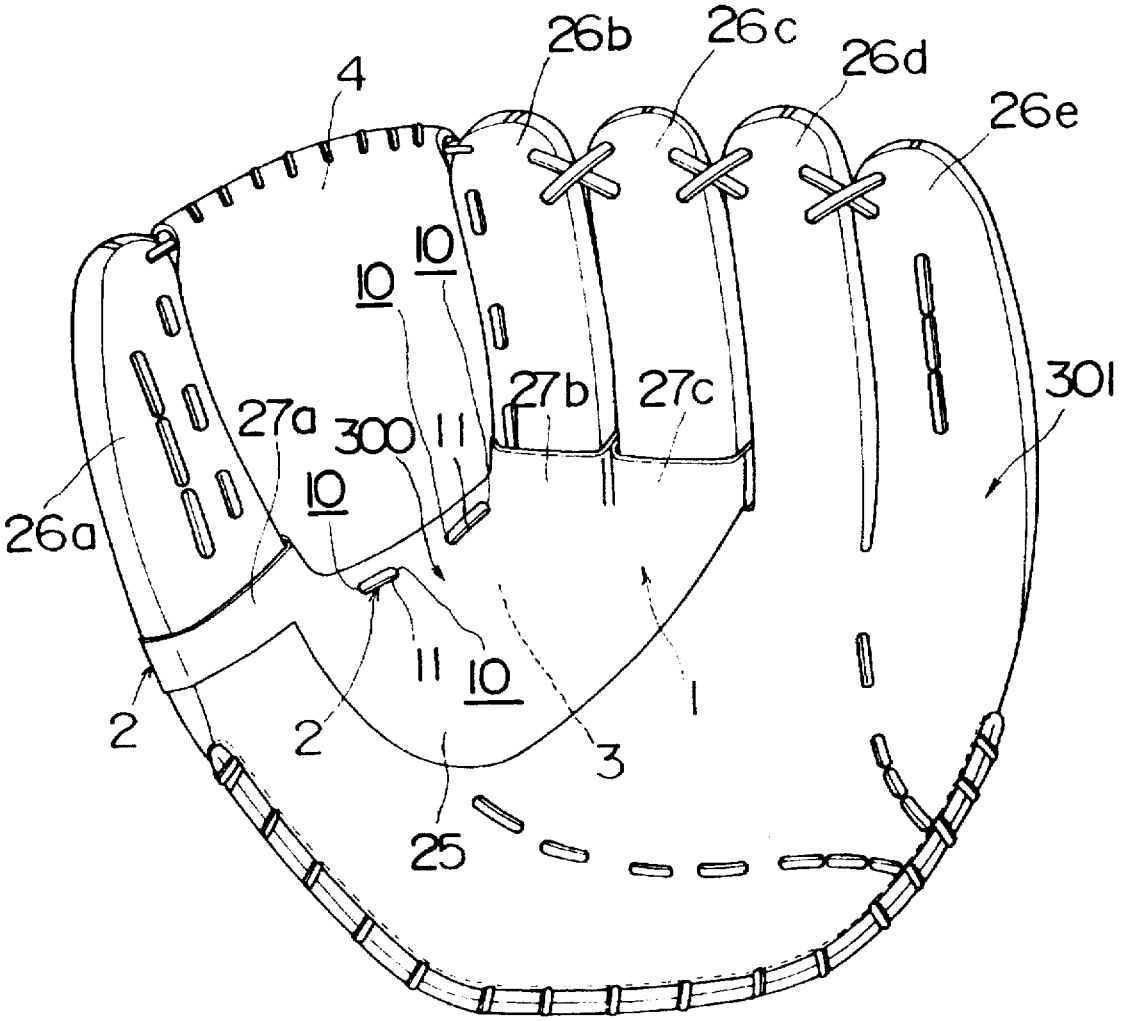
FIG. 19 is a perspective view showing the state, as taken from the side of a catching face, in which a baseball glove protecting cover according to a third embodiment is fastened on the baseball glove.

What is shown in FIG. 19 is the protective cover 300 according to the third embodiment. Specifically, the protective cover 300 of the third embodiment is an improvement over the protective cover 300 of the first embodiment and is constructed such that the cover body 1 is reduced in size by extending only the finger members 27*b* and 27*c* from the upper end of the catching portion 25, as shown in FIG. 19, but can protect only the catching face 3 of the glove 300 that is especially liable to wear. More specifically, this protective cover 300 of the third embodiment is the most preferable for productions and sales in all the protective covers 300 to be fastened on the glove 301.

Figure 20:
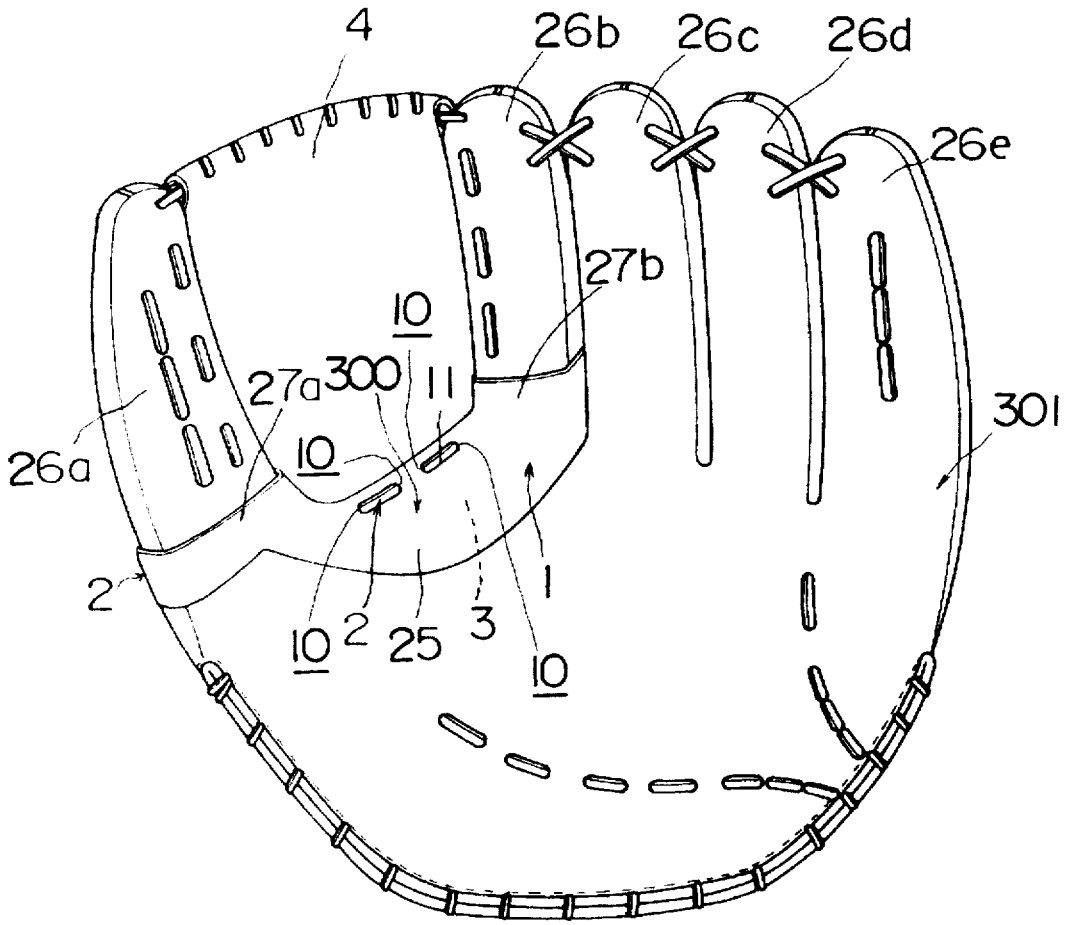
FIG. 20 is a perspective view showing the state, as taken from the side of a catching face, in which a baseball glove protecting cover according to a fourth embodiment is fastened on the baseball glove.

What is shown in FIG. 20 is the protective cover 300 according to the fourth embodiment. Specifically, the protective cover 300 of the fourth embodiment is an improvement over the protective cover 300 of the first embodiment and is constructed such that the cover body 1 is so further reduced in size by extending only the finger member **27*b* from the upper end of the catching portion 25, as shown in FIG. 20, as to protect only the catching face 3 of the glove 300** that is especially liable to wear.

Thus, when the protective cover 100 according to the first embodiment is to be fastened for the practices on the catcher mitt 101, the following procedures are taken. With the cover body 1 being held in contact with the catching face 3 of the mitt 101 such that the accommodating portions 8 of the cover body 1 are in abutment against the side end portions 7 of the mitt 101, as shown in FIG. 2, the U-shaped needle 12 is threaded around the leading end of the strap 11, and the stitch holes 10 of the cover body 1 and the hemming strap 13 of the mitt 101 are entangled with the strap 11 by means of the needle 12 such that the cover body 1 is fastened on the catching face 3 of the mitt 101, as shown in FIG. 1. Specifically, the baseball can be practiced by using the mitt 101 which has its catching face 3 protected by the protective cover 100. For a baseball match, on the other hand, the protective cover 100 is removed by releasing the strap 11 of the fastening means 2. In these ways, the cover body 1 can be removably fastened for the practices or matches or by preference on the catching face 3 of the mitt 101.

According to the protective cover 100 of the second embodiment, on the other hand, the accommodating portions 8 of the cover body 1 are equipped on their inner faces with the face fasteners **14*a* of one type, and the face fasteners 14*b* of other type are adhered to the surfaces of the side end portions 7 of the mitt 101. For the practices, a portion of the cover body 1 can be fastened on the catching face 3 of the mitt 101 with the face fasteners 14 merely by pushing the accommodating portions 8 of the cover body 1 onto the side end portions 7 of the mitt 101. Likewise, the cover body 1 can be fastened on the catching face 3 of the mitt 101, as shown in FIG. 1, merely by entangling the stitch holes 10 of the cover body 1 and the hemming strap 13 of the mitt 101 with the strap 11**.

When the protective cover 100 of the fourth embodiment is to be fastened, its cover body 1 is held in contact with the catching face 3 of the mitt 101. Then, the fastening bands **15*a* and 15*a* are inserted through the gaps 17 and 17, which are formed between the body of the mitt 101 and the web cover 4, to embrace the web cover 4 with the face fasteners 14*a* and 14*b*, as shown in FIG. 6. Then, the fastening bands 15*b* and 15*b* are inserted into the retaining strap 16, as shown in FIG. 6, to embrace the leading end of the mitt 101 with the face fasteners 14*a* and 14*b*, and the remaining fastening bands 15 are retained around the retaining straps 16, as shown in FIG. 6**.

Figure 9:
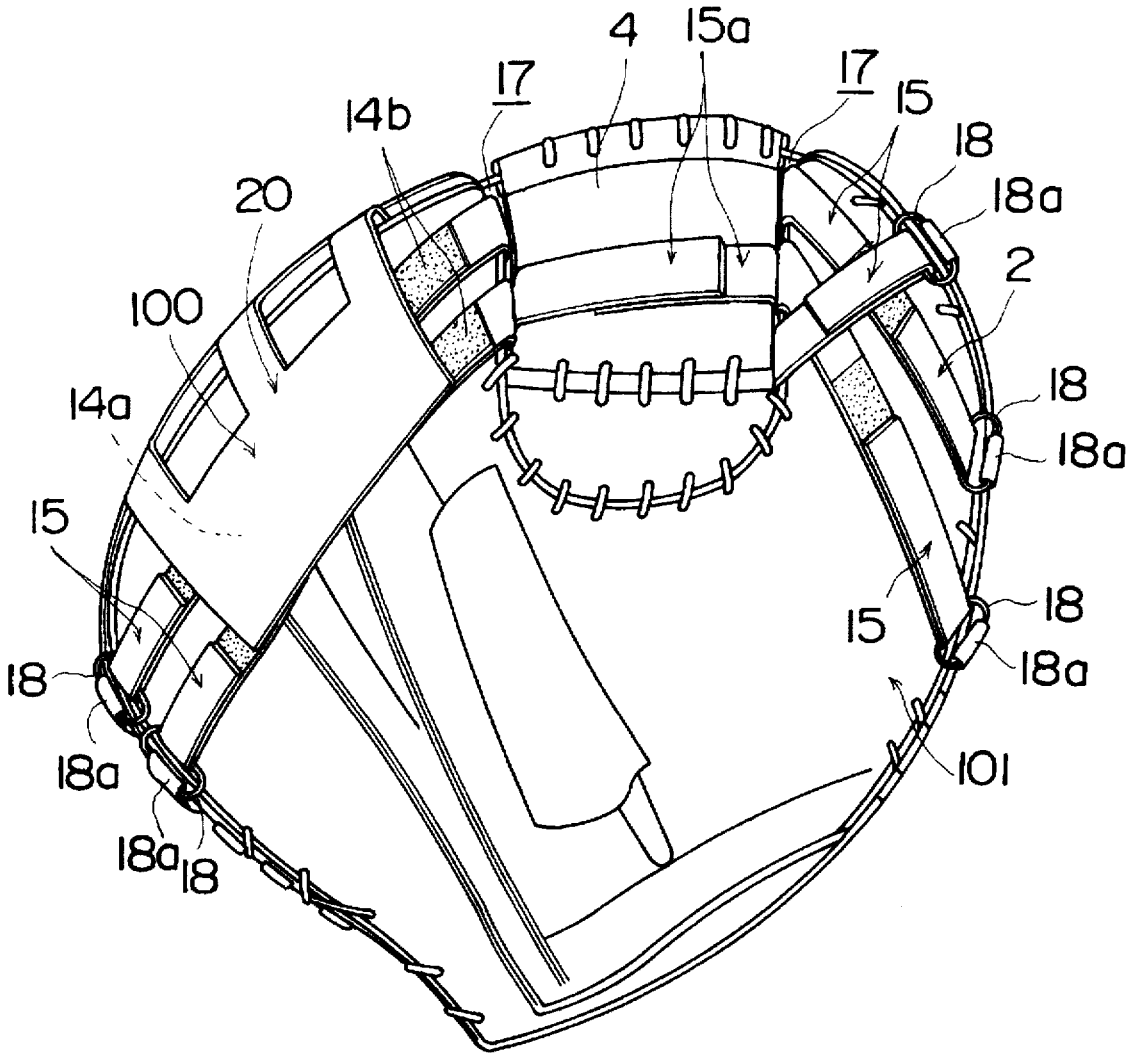
FIG. 9 is a perspective view taken from the back and showing the state in which the same protective cover is fastened on a catcher mitt.

When the protective cover 100 of the fifth embodiment is to be fastened, its cover body 1 is held in contact with the catching face 3 of the mitt 101. Then, the fastening bands **15*a* are inserted through the gaps 17 between the body of the mitt 101 and the web cover 4 to embrace the web cover 4 with the face fasteners 14*a* and 14*b*, and the fastening bands 15 are inserted through the gaps 17 between the body of the mitt 101 and the web cover 4, as shown in FIG. 9, and are folded back around the individual fixing rings 18 and fastened with the face fasteners 14*a* and 14*b*. In addition, the cover body 1 is fixed by pushing the face fastener 14*a* of the auxiliary fastening band 20 onto those face fasteners 14*b***.

When the protective cover 100 of the sixth embodiment is to be fastened, it is fastened on the mitt 101 by threading the strap 11 into the ring members 21 and by entangling it with the hemming strap 13 of the mitt 101 or the new retaining strap 16. Another method of fastening the protective cover 100 can be accomplished by using not the strap 11 but the openable rings 22, as shown in FIG. 11, to retain them through the ring members 21 and the hemming straps 13 and 13 of the mitt 101.

When the protective cover 200 of the first embodiment is to be fastened on the first mitt 201, the fastening bands **15*a* and 15*a* of the protective cover 200 are folded back and anchored around the web cover 4 of the first mitt 201, as shown in FIG. 13, by means of the face fasteners 14, and the fastening bands 15*b* and 15*b* are folded back and anchored around the thumbstall 23 of the first mitt 201 by means of the face fasteners 14. The other fastening bands 15 can be retained on the retaining straps 16 at the back of the first mitt 201 by means of the face fasteners 14. In other words, the first mitt 201 can be used for the baseball practices such that its catching face 3 is protected by the protective cover 200. For the matches, on the other hand, the fastening bands 15 of the fastening means 2 are released to remove the protective cover 200 from the catching face 3 of the mitt 201. Thus, the cover body 1 can be removably fastened for the practices or matches or by preference on the catching face 3 of the mitt 201**.

The protective cover 200 of the second embodiment is made similar, as shown in FIG. 15, to the protective cover 200 of the first embodiment, but the fastening bands 15 are inserted into the body cut 24 so that they are retained around the retaining straps 16 at the back of the first mitt 201.

According to the protective cover 300 of the first embodiment used with the glove 301, moreover, for the practices, the cover body 1 is held in contact with the catching face 3 of the glove 301, and the fastening bands 28 are inserted through the gaps between the individual fingerstalls 26 of the glove 301, as shown in FIG. 16, and are anchored around the fingerstalls 26 with the face fasteners 14. Likewise, the strap 11 is threaded into the stitch holes 10 of the cover body 1 and entangled with the hemming strap 13 of the glove 301. Thus, the cover body 1 can be fastened on the catching face 3 of the glove 301, as shown in FIG. 16. The protective covers 300 of the third and fourth embodiments can be likewise fastened, as shown in FIGS. 19 and 20.

According to the protective cover 300 of the second embodiment, furthermore, for the practices, the cover body 1 is held in contact with the catching face 3 of the glove 301. At the same time, the fastening band **28*a* is folded around the thumbstall 26*a* of the glove 301, and the retaining rings 29 are inserted into the gaps between the forefinger stall 26*b* and the middle finger stall 26*c*, between the middle finger stall 26*c* and the third finger stall 26*d*, and the third finger stall 26*d* and the little finger stall 26*e* to the back of the glove 301. Then, the fastening band 30 is inserted into the retaining rings 29 and is retained with the fastening band 31 with the face fasteners 14. Likewise, the strap 11 is inserted into the stitch holes 10 of the cover body 1 and is entangled with the hemming strap 13 of the glove 301 so that the cover body 1 can be fastened on the catching face 3 of the glove 301**.

Incidentally, the baseball mitt or glove can be sold such that the aforementioned protective cover 100, 200 or 300 is fastened on the ordinary baseball mitt or glove. In this case, the sale of the baseball mitt or glove is highly promoted.

Thus, according to the representative embodiments of the protective covers 100, 200 and 300 of the present invention, the mitts 101 201 and glove 301 can have their catching faces 3 protected by the cover body 1 so that they can stand long use. Thus, the baseball mitts 101 and 201 and the baseball glove 301, which are seasoned and customized, can be used in matches for a long time.

Especially, in case the protective cover 100 of the first embodiment is used, for the practices, it can be fastened on the catcher mitt 101 in the following procedures. With the cover body 1 being held in contact with the catching face 3 of the mitt 101 such that the accommodating portions 8 of the cover body 1 are in abutment against the side end portions 7 of the mitt 101, the stitch holes 10 of the cover body 1 are entangled with the strap 11 of the fastening means 2 by means of the needle 12 such that the cover body 1 is fastened on the catching face 3 of the mitt 101. As a result, the mitt 101 can always be used such that its catching face 3 is covered with the cover body 1 without having the protective cover 100 removed no matter how hard the practices might be.

In case the protective cover 100 of the second embodiment is used, on the other hand, the accommodating portions 8 of the cover body 1 are equipped on their inner faces with the face fasteners 14*a* of one type, and the face fasteners of other type are adhered to the surfaces of the side end portions 7 of the mitt 101. For the practices, a portion of the cover body 1 can be tentatively fixed on the catching face 3 of the mitt 101 with the face fasteners 14 merely by pushing the accommodating portions 8 of the cover body 1 onto the side end portions 7 of the mitt 101. As a result, the positioning on the catching face of the mitt can be facilitated.

In case, the protective cover 100 of the fourth embodiment is used, the cover body 1 can be easily fastened on and removed from the mitt 101 by using the fastening bands 15 of the cover body 1 and the retaining straps 16 of the mitt 101.

In case the protective cover 100 of the fifth embodiment is used, the fastening bands 15 are inserted through the gaps 17 between the body of the mitt 101 and the web cover 4 of the mitt 101, as shown in FIG. 9, and are folded back around the individual fixing rings 18 and fastened with the face fasteners 14*a* and 14*b*. In addition, the cover body 1 is fixed by pushing the face fastener 14*a* of the auxiliary fastening band 20 onto those face fasteners 14*b*. As a result, the protective cover 100 can be more fixedly fastened on the mitt 101 than the protective cover 100 of the fourth embodiment so that it will not come out from the mitt 101 during the practices.

When the protective cover 100 of the sixth embodiment is used, it can be fixedly fastened on the mitt 101 by threading the strap 11 into the ring members 21 and by entangling it with the hemming strap 13 of the mitt 101 or the new retaining strap 16. If another method is employed for fastening the protective cover 100, it can be accomplished by using not the strap 11 but the openable rings 22, as shown in FIG. 11, to retain them through the ring members 21 and the hemming straps 13 and 13 of the mitt 101, then the fastening operation can be highly simplified.

In case the protective cover 200 of the first embodiment is used, It can be fixedly fastened on the first mitt 201. Specifically, the fastening bands 15*a* and 15*a* of the protective cover 200 are folded back and anchored around the web cover 4 of the first mitt 201, as shown in FIG. 13, by means of the face fasteners 14, and the fastening bands 15*b* and 15*b* are folded back and anchored around the thumbstall 23 of the first mitt 201 by means of the face fasteners 14. The other fastening bands 15 can be retained on the retaining straps 16 at the back of the first mitt 201 by means of the face fasteners 14. Thus, the protective cover 200 can be easily fastened and removed.

Especially in case the protective cover 200 of the second embodiment is used, its production cost can be reduced, as compared with the protective cover 200 of the first embodiment, because its size is sufficient for protecting only the catching face 3 of the first mitt 201.

In case the protective cover 300 of the first embodiment is used with the baseball glove 301, moreover, for the practices, the cover body 1 is held in contact with the catching face 3 of the glove 301, and the fastening bands 28 are inserted through the gaps between the individual fingerstalls 26 of the glove 301, and are anchored around the fingerstalls 26 with the face fasteners 14. Likewise, the strap 11 is threaded into the stitch holes 10 of the cover body 1 and entangled with the hemming strap 18 of the glove 301. Thus, the cover body 1 can be fastened on the catching face 3 of the glove 301, as shown in FIG. 16. Thus, the protective cover 300 can be reliably fastened on the glove 301.

In case the protective cover 300 of the second embodiment is used, moreover, its structure can be simplified for similar effects because the number of its face fasteners 14 can be made smaller than that of the protective cover 300 of the first embodiment.

In case the protective cover 300 of the third or fourth embodiment is used, moreover, its production cost can be drastically reduced because the area of the catching face 25 is reduced.

With the structures thus far described, the present invention can achieve the following effects.

According to the baseball mitt protecting cover of the claim 1, the baseball mitt of the claim 3, the baseball glove protecting cover of the claim 5, and the baseball glove of the claim 7, the catching faces, which are especially liable to wear, are protected for the frequent practices with the cover bodies so that the baseball mitt and glove can stand long use. As a result, the baseball mitt and glove, which are seasoned and customized, can be used for the matches for a long time.

According to the baseball mitt protecting cover of the claim 2 and the baseball mitt of the claim 4, the cover body can be fastened in contact on the catching face of the mitt by threading and folding back the fastening bands of the fastening means into and around the retaining strap and by fixing them with the face fasteners. As a result, the protective cover will not come out of the mitt no matter how hard the practices might be, so that the mitt can always be used with the cover body held in contact with its catching face. Moreover, the fastening band can be entangled with and removed from the retaining strap by making use of the face fasteners so that the protective cover can be easily fastened and removed.

According to the baseball glove protecting cover of the claim 6 and the baseball glove of the claim 8, the cover body can be fastened for the practices on the catching face of the glove by bringing the cover body into contact with the catching face of the glove, by threading the fastening bands between the individual fingerstalls of the glove to embrace the fingerstalls, and by fixing the fastening bands with the face fasteners. As a result, the protective cover can be reliably fastened on the glove without restricting the motions of the individual fingerstalls of the glove. Moreover, the protective cover can be easily fastened and removed because the face fasteners are used for fastening the fastening bands.

What is claimed is:

1. A baseball mitt protecting cover in combination with a baseball mitt, for protecting a catching face of the baseball mitt, wherein the baseball mitt includes a portion for receiving a hand, a catching face, a rear surface and a retaining strap on the rear surface of the mitt, comprising:

a supple sheet cover body sized to protect the catching face of the baseball mitt; and fastening means for removably fastening said supple sheet cover body on the catching face of said mitt.

2. A baseball mitt in combination with a protective cover for protecting the baseball mitt, comprising:

the baseball mitt comprising a portion for receiving a hand, a catching face, a rear surface, and a retaining strap arranged on the rear surface of said mitt;

said protective cover comprising a sheet cover body sized to protect said catching face of the baseball mitt; and fastening means for removably fastening said cover body on said catching face of said mitt.

3. A baseball glove protecting cover in combination with a baseball glove, for protecting a catching face of the baseball glove, wherein the baseball glove includes a plurality of fingerstalls and a thumbstall for respectively receiving fingers and a thumb, a catching face, and a rear surface, comprising:

a supple sheet cover body sized to protect a catching face of a baseball glove; and fastening means for removably fastening said supple sheet cover body on the catching face of said glove.

4. A baseball glove in combination with a protective cover for protecting the baseball glove, comprising:

the baseball glove comprising a plurality of fingerstalls and a thumbstall for respectively receiving fingers and a thumb, a catching face, and a rear surface;

said protective cover comprising a sheet cover body sized to protect said catching face of said baseball glove; and fastening means for removably fastening said cover body on said catching face of said glove.

* * * * *